US005267643A

United States Patent [19]

Scribner

[11] Patent Number: 5,267,643

[45] Date of Patent: Dec. 7, 1993

[54] OUTDOOR PLASTIC INFORMATION DISPENSER

[76] Inventor: Richard C. Scribner, 1900 Point West Way, Suite 122, Sacramento, Calif. 95815

[21] Appl. No.: 991,707

[22] Filed: Dec. 16, 1992

Related U.S. Application Data

[63] Continuation of Ser. No. 817,100, Jan. 6, 1992, abandoned.

[51] Int. Cl.[5] ..... B65D 33/16

[52] U.S. Cl. ..... 206/45.33; 206/44 B; 206/806; 383/81

[58] Field of Search ..... 383/9, 35, 29, 78, 79, 383/81; 206/45.33, 45.34, 45.31, 806, 495, 449, 44 B; 150/153, 154; 40/661, 644

[56] References Cited

U.S. PATENT DOCUMENTS

| | | | |
|---|---|---|---|
| 606,366 | 6/1898 | Southard | 383/78 |
| 1,981,711 | 11/1934 | Russell | 383/79 |
| 2,439,584 | 4/1948 | Schumann | 206/45.34 |
| 2,722,960 | 11/1955 | Austad | 383/81 X |
| 2,751,071 | 6/1956 | Goldband | 206/45.33 X |
| 2,843,309 | 7/1958 | Wheeler | 383/79 X |
| 3,026,016 | 3/1962 | Scher | 206/45.34 |
| 3,034,640 | 5/1962 | Evans | 206/45.34 |
| 4,385,722 | 5/1983 | Brewill | 206/45.34 X |
| 4,824,261 | 4/1989 | Provost | 383/79 X |
| 4,983,047 | 1/1991 | Netto | 383/79 X |
| 5,009,515 | 4/1991 | Bennett | 206/45.34 X |
| 5,069,334 | 12/1991 | Herrin et al. | 206/45.34 |

FOREIGN PATENT DOCUMENTS

| | | | |
|---|---|---|---|
| 0257978 | 3/1988 | European Pat. Off. | 383/79 |
| 0802580 | 9/1936 | France | 383/79 |

*Primary Examiner*—Steven N. Meyers
*Assistant Examiner*—Jacob K. Ackun, Jr.

[57] ABSTRACT

A hangable packaging and information dispensing device being a transparent plastic bag and plastic hanger/-flap for displaying and dispensing printed information in the form of flyers, photographs, statistics, sales brochures, instructions and messages in an outdoor setting. The plastic bag is of a different material than the plastic hanger/flap. A method of forming the hanger/flap and bonding with the plastic bag is disclosed.

9 Claims, 1 Drawing Sheet

OUTDOOR PLASTIC INFORMATION DISPENSER

This is a continuation of copending application Ser. No. 07/817,100 filed on Jan. 6, 1992, now abandoned.

BACKGROUND OF THE INVENTION

This invention relates to the packaging and dispersion of printed, typed or written information flyers, photographs, statistics, sales brochures and messages, and more particularly to the packaging and dispersion of real estate marketing flyers in a variety of outdoor scenarios.

Outdoor marketing and disseminating of printed, typed or written information often comprises of the hanging and/or mounting of an informational flyer/-brochure dispenser to a marketing sign, post or other suitable outdoor location for the public dissemination of the information. Prior displays include partially transparent and non-transparent hard plastic construction including displays made from lexan, acrylic or corrugated polypropylene. These prior brochure displays tend to be, by the nature of their construction, relatively expensive, non-resistant to vandalism, difficult to store and transport, and virtually non-repairable when damaged. Prior displays make it difficult, if not impossible, to view the contents of the display from a distance from, say, a car window or on foot. To overcome the difficulties of the prior art, this invention utilizes a transparent plastic contents bag, preferably of clear, soft vinyl, for the display of the informational contents. Another negative characteristic of the prior art is that the contents of these displays are held loosely causing the sheet paper contents to become "dog-eared" and to otherwise droop and lose their shape. The design of the present invention holds the contents tightly and securely regardless of the content volume. The vinyl design of the present invention may contain properties that help block a majority of the ultra-violet sun rays that could damage the contents of the dispenser under certain circumstances.

The plastic contents bag is suitable for having an instructional message printed directly on it, or a label or sticker bearing instructional wording may be applied.

To give the plastic contents bag of the present invention adequate support and stability necessary for its intended purpose, a combination hanger/flap is formed from a single piece of corrugated polypropylene plastic. This hanger/flap provides the user with a variety of positions and attachment locations in which to attach the invention to a variety of outdoor locations. This hanger/flap also provides a permanent self-closing flap that seals out inclement weather and unwanted elements in the plastic contents storage bag. This hanger/flap is also suitable for having instructional messages displayed on it either by printing directly on its surface or applying a vinyl or mylar self-adhesive sticker on its surface. The corrugated polypropylene plastic hanger/flap can be manufactured in many different colors so as to encourage corporate user identification.

SUMMARY OF THE INVENTION

It is the primary object of the present invention to provide a hangable packaging and dispensing device from one material supported by a one piece hanger/flap made of another material and joined together by a third material.

It is another object of the present invention to provide for packaging and dispensing of informational flyers, photographs, statistics, sales brochures, instructions and messages contained, carried and displayed within a transparent plastic container bag, preferably made from soft, clear vinyl.

It is a further object of the present invention to provide a rigid mountable and hangable hanger/flap formed from a plastic material, preferably corrugated polypropylene, different from the material used in constructing the plastic container bag within which the informational contents are carried. The self closing hanger/flap is permanently secured to the plastic contents carrier bag while permitting the container to be opened for contents inspection and removal.

It is a further object of the present invention to provide permanent instructional wording to be placed on the plastic contents container bag and/or on the plastic hanger/flap either by printing directly on the plastic surface or by permanently affixing a sticker or label so that the printed instructional wording may be read from a distance by those intending to retrieve the informational contents.

Accordingly, one aspect of the present invention is the provision of a plastic display container having a plastic rigid hanger/flap for supporting the display container and protecting the contents of the container from the elements, the contents container bag preferably being formed from clear vinyl, and the hanger/flap being preferably formed from colored corrugated polypropylene. The bottom of the hanger/flap is secured to the top of the contents display bag and is folded over in half to form a flap over the opening of the contents display container. The hanger/flap shape is retained in this position by fastening grommets. With this construction, the hanger/flap and the contents display container may be formed of different plastic materials.

Another aspect of the present invention is that in the process of securing the hanger/flap to the contents display container, the present invention provides for permanent attachment by way of fastening grommets. These evenly spaced fasteners not only provide a durable attachment point between bag and hanger/flap, they also provide the user with a variety of display options due to the holes formed in the hanger/flap by the fastening grommets. Through these grommet holes, the present invention can be hung or mounted from any surface that can take a nail, screw, hook, tie or other temporary or permanent mounting or hanging bracket or device.

BRIEF DESCRIPTION OF THE DRAWINGS

The particular features and advantages of the invention as well as other objects will become apparent from the following descriptions taken in connection with the accompanying drawings, in which.

DESCRIPTION OF THE PREFERRED EMBODIMENTS

Figure 1:
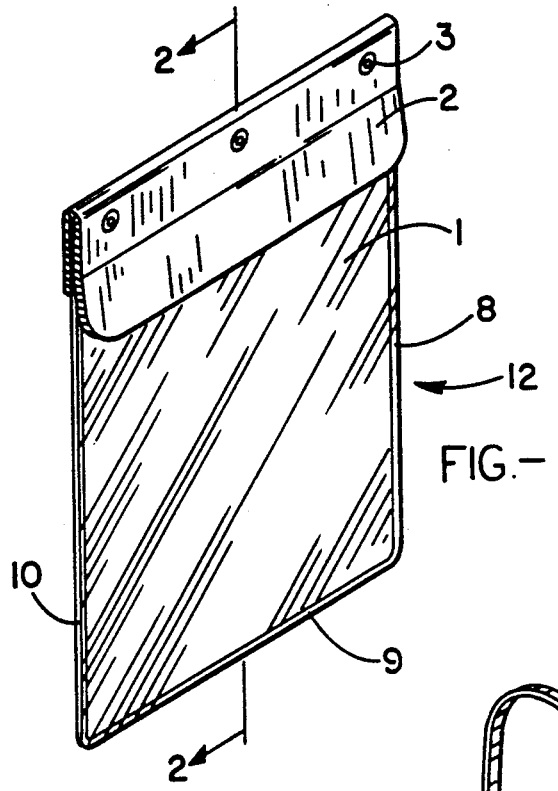
FIG. 1 is a perspective view of a plastic display container constructed in accordance with the principles of the present invention.
Figure 3:
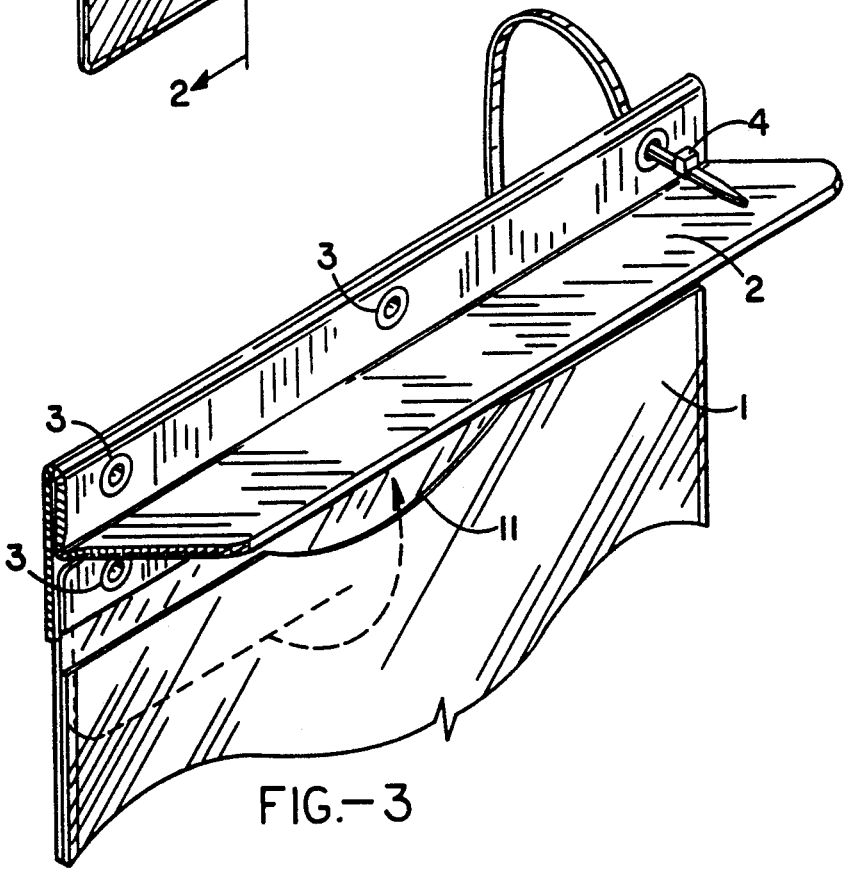
FIG. 3 is a perspective view of the upper portion of the plastic display container of FIG. 1 illustrating the attachment of the plastic container to the plastic hanger/flap and the opening action of the hanger/flap.

Referring now to the drawings, FIG. 1 illustrates a hangable and or/mountable packaging and display dispenser 12 constructed in accordance with the present invention. The invention is generally comprised of a plastic bag 1 capable of holding informational contents and being supported on a marketing sign, post or other suitable outdoor location by means of a plastic hanger/flap 2, preferably comprised of corrugated polypropylene. The plastic bag 1, which is preferably comprised of a transparent plastic material such as vinyl, preferably is formed from two sheets 6, 7 of plastic film, either with or without treatment for ultraviolet screening. The two layers are bonded together at three edges 8, 9, 10 to form the sides and bottom of the plastic bag. The top of the bag has one sheet 7 longer than the other sheet 6 at the top end. The elongated upper end portion of the longer sheet 7 forms the lip that the plastic hanger/flap 2 attaches to. The shorter sheet 6 is unsecured at the top so that the informational contents may be inserted and retrieved. FIG. 3 shows the top edge of the shorter sheet 6 with a scalloped edge 11 to ease the placement and retrieval of the informational contents of the plastic bag 1.

Figure 2:
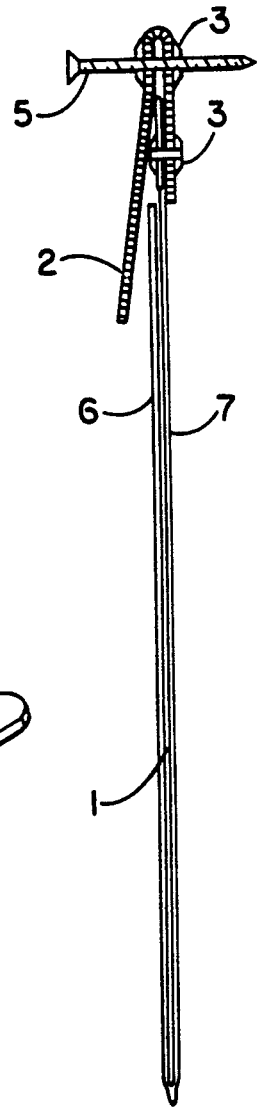
FIG. 2 is a cross sectional view taken substantially along the line 2—2 of FIG. 1.

FIG. 2 shows the fastening attachment of the elongated upper portion of sheet 7 to the plastic hanger/flap 2 by way of evenly spaced grommets 3. At a point above the attachment of the elongated sheet 7 to the hanger/flap 2, the hanger/flap 2 is folded in half towards the front of the invention and downwards to the shorter sheet 6. This fold is secured by evenly spaced fastening grommets 3.

FIG. 3 illustrates a third fold placed in the hanger/flap 2 just above the top of the unsecured shorter sheet 6. This third fold is left unsecured and establishes a covering flap for the entrance to the informational contents of the plastic bag 1. The opening action of the hanger/flap 2 that this third fold creates is illustrated in FIG. 3.

It will be appreciated that the invention can be fastened to a marketing sign, post or other suitable outdoor location by means of a screw, nail, adjustable nylon tie or other fastening device which is inserted through grommets 3.

Numerous alterations of the structure herein disclosed will suggest themselves to those skilled in the art. However, it is understood that the present disclosure relates to the preferred embodiment of the invention which is for purposes of illustration only and not to be construed as a limitation of the invention. All such modifications which do not depart from the spirit of the invention are intended to be included within the scope of the claims.

Having thus set forth the nature of the invention, what is claimed herein is:

1. A self-closing dispenser device, comprising:
(a) a generally rectangular dispenser body, said dispenser body having an open top, a closed bottom and a pair of closed sides, said dispenser body including a back panel, said back panel including a lip having a front surface and a back surface; and
(b) a hanger, said hanger fastened to said back surface of said lip of said dispenser body, said hanger including a first fold about which said hanger extends over said lip from said back surface to said front surface, said hanger including a self-closing flap cover, said flap cover defined by and articulating about a second fold in said hanger, said second fold positioned vertically below said first fold and vertically above said open top, said flap cover extending over said open top of said dispenser body, said flap cover normally covering said open top of said dispenser body without application of external force, whereby entry into said container is gained by deflecting said flap cover about said second fold.

2. An apparatus as recited in claim 1, further comprising a plurality of grommets, said grommets fastening said hanger to said lip.

3. An apparatus as recited in claim 1, wherein said hanger and said flap comprise corrugated polypropylene material.

4. An apparatus as recited in claim 1, wherein said dispenser body includes a front layer of plastic material, said front layer and said back layer having bonded corresponding edges defining said closed bottom and said closed sides of said dispenser, said front layer including a scalloped upper edge.

5. A hanging packaging and display dispenser, comprising:
(a) a first and second generally planar layer of plastic material, each said layer including an upper edge, a lower edge and a pair of side edges, the corresponding lower and side edges of said first and second layers bonded to form a generally rectangular container having a closed bottom, closed sides, and an open top, said first layer including a lip extending beyond said upper edge of said second layer, said lip having front and back surfaces; and
(b) a hanger, said hanger having first and second edges, said hanger fastened to said back surface of said lip near said first edge, said hanger including a first fold about which said hanger extends over said lip from said back surface to said front surface, said hanger including a self-closing flap, said flap defined by and articulating about a second fold in said hanger, said second fold positioned vertically below said first fold and vertically above said open top, said flap extending over said open top of said container, said flap covering said open top of said container without application of external force, said flap being deflectable about said second fold for entry into said open top of said container.

6. An apparatus as recited in claim 5, further comprising a plurality of grommets, said grommets fastening said hanger to said lip.

7. An apparatus as recited in claim 6, wherein said hanger and said flap comprise corrugated polypropylene material.

8. An apparatus as recited in claim 7, wherein said second layer includes a scalloped upper edge.

9. An information dispenser for mounting to a sign, post or other support structure, comprising:
(a) a pair of generally rectangular opposing layers of plastic material having corresponding lower edges and side edges bonded to form a bag having an open top, one of said layers of plastic material including a lip extending beyond said open top, the other of said layers having a scalloped upper edge;
(b) a corrugated hanger, said hanger including a corrugated flap, said hanger enveloping said lip about a first fold, therein said flap covering said open top, said flap defined by and being deflectable about a second fold in said hanger positioned vertically below said first fold and vertically above said open top of said bag, said flap being self-closing without application of external pressure, whereby materials can be inserted into or removed from said bag by deflecting said flap away from said bag about said second fold and said flap re-closes without application of external force after being deflected; and (c) a plurality of grommets, said grommets securing said hanger to said lip.

* * * * *